US005417809A

United States Patent [19]

Hoffman et al.

[11] Patent Number: 5,417,809

[45] Date of Patent: May 23, 1995

[54] WATER REUSE SYSTEM INCORPORATING VACUUM PUMP SEALING WATER IN A ZERO DISCHARGE PROCESS

[75] Inventors: Roger P. Hoffman, Green Bay; Gerald O. Walraven, Sturgeon Bay, both of Wis.

[73] Assignee: Hoffman Environmental Systems, Inc., Green Bay, Wis.

[21] Appl. No.: 298,198

[22] Filed: Aug. 31, 1994

[51] Int. Cl.[6] ..... D21F 1/66; D21F 1/48; D21F 1/76

[52] U.S. Cl. ..... 162/190; 162/264; 162/363; 162/189; 162/279

[58] Field of Search ..... 162/189, 190, 363, 359.1, 162/264, 278, 279, 252, 335, 351, 364, 263; 34/74, 468, 469

[56] References Cited

U.S. PATENT DOCUMENTS

| | | | |
|---|---|---|---|
| 2,771,823 | 11/1956 | Lukemire | 162/190 |
| 3,801,436 | 2/1974 | Prechtel | 162/264 |
| 3,833,468 | 9/1974 | Boniface | 162/264 |
| 3,907,630 | 9/1975 | Selander et al. | 162/190 |
| 3,988,201 | 10/1976 | Smith, Jr. | 162/359.1 |
| 4,221,630 | 9/1980 | Selander et al. | 162/190 |
| 4,466,873 | 8/1984 | Bolton et al. | 162/217 |

*Primary Examiner*—W. Gary Jones
*Assistant Examiner*—Jose A. Fortuna
*Attorney, Agent, or Firm*—Andrus, Sceales, Starke & Sawall

[57] ABSTRACT

A papermaking water system utilizing vacuum pump sealing water and having a zero sealing water discharge. A group of water seal vacuum pumps are used in a papermaking machine to generate subatmospheric pressure in suction equipment and thereby extract water from a wet paper web. During operation of the vacuum pumps, the sealing water is heated and the heated water is discharged to a cooling tower to cool the water which is then recirculated to the vacuum pumps. Steam from a generating plant is supplied to the dryer drums in the dryer section of the papermaking machine, and the steam condensate is combined with the heated sealing water flowing to the cooling tower. By using steam condensate as makeup water, no ionic buildup will occur in the closed system, and high quality water is withdrawn from the closed system and may be used in other sections of the papermaking machine, so that there is no discharge of sealing water to the sewer system.

6 Claims, 1 Drawing Sheet

WATER REUSE SYSTEM INCORPORATING VACUUM PUMP SEALING WATER IN A ZERO DISCHARGE PROCESS

BACKGROUND OF THE INVENTION

The typical papermaking machine incorporates a number of vacuum pumps for creating a vacuum or subatmospheric pressure in various suction devices, such as suction boxes and couch rolls, used to extract water from the wet paper web. Water seal vacuum pumps are commonly used, as opposed to centrifugal pumps, and depending upon its location of use, each vacuum pump may be required to generate a high vacuum up to about 24 inches of mercury, or a lower vacuum down to 3 inches of mercury. The typical water seal vacuum pump uses substantial quantities of sealing water up to perhaps 100 gallons per minute. As a typical papermaking machine may incorporate from five to seven vacuum pumps, the pumps can utilize up to 700 gallons of sealing water per minute.

The sealing water is heated by the mechanical action of the pump itself, as well as by condensation of water vapor which is drawn from the suction box or couch roll. It is important to prevent the sealing water from being heated to a temperature that could cause vaporization, and thus the common practice has been to cool the sealing water by passing the water through a cooling tower and then recirculating it to the vacuum pump. In the cooling tower some evaporization occurs, which thereby increases the concentration of dissolved inorganic salts and additional makeup water is thus required. Due to the increase in concentration of inorganic salts, it has been the practice to utilize a "blow down" in which about 10% of the water is continuously discharged and additional makeup water is added. The specific amount of water discharged in the "blow down" depends on the salt concentration of the makeup water.

With the advent of small papermaking mills using recycled paper, it is desirable to locate such mills in urban sites, in close proximity to both available waste paper supply and the key markets for paper. With an urban location there is a critical need to have zero water discharge from the papermaking system, so as to minimize environmental impact.

To facilitate low energy costs, papermaking mills are preferably situated in close proximity to power plants and low pressure steam from the power plant turbine exhaust can be supplied to the dryer drums of the dryer section of the papermaking machine to dry the paper. The steam condensate is discharged from the dryer drums to a condensate receiver tank and the condensate can either be returned to the power plant or discharged to the sewer. While the steam condensate, or other condensate from evaporation systems, contains only a fraction of the ionic content of water from a typical municipal system, it can be contaminated with iron oxide or other trace impurities. Since power is normally generated in high pressure turbines, it is critical that the water being supplied to the turbines be extremely low in all contamination. As the dryer drums in the dryer section of the papermaking machine are basically rotating pressure vessels with rotary seals for steam and condensate, the condensate can, at times, become contaminated due to seal leakage. Therefore in many cases the steam condensate from the dryer drums cannot be returned to the power plant for use as makeup water. Because of this, it has been the common practice to discharge the condensate from the dryer drums to the sewer or waste system.

SUMMARY OF THE INVENTION

The invention is directed to a papermaking system utilizing water seal vacuum pumps and having zero water discharge.

In the papermaking machine a number of water seal vacuum pumps are employed to generate a subatmospheric pressure or vacuum in various suction devices, such as suction boxes, couch rolls and the like, in order to extract water from the wet paper web which is moving across the suction device.

During operation of a water seal vacuum pump, the sealing water is heated due to the mechanical operation of the pump, as well as due to condensation of water vapor which is drawn from the suction device. To maintain the sealing water at a desired temperature range, the heated water is discharged from the vacuum pump to a cooling tower to cool the water which is then recirculated to the pump.

In accordance with the invention, steam from a steam generating plant is supplied to the dryer drums in the dryer section of the papermaking machine, and the steam condensate from the dryer drums is combined with the heated sealing water flowing from the vacuum pump to the cooling tower.

By using the steam condensate, which is substantially free of dissolved salts, as makeup water for the vacuum pump sealing water system, the normal "blow down" can be reduced by nearly 90 percent, and the water being removed from the closed system in the "blow down" has a low ionic content and can be used in other sections of the papermaking machine. Thus, the invention achieves zero discharge from the vacuum pump sealing water system. Further, the use of the steam condensate reduces the buildup of inorganic salts in the closed sealing water system, thus reducing scale formation on the operating components, and correspondingly reducing maintenance costs.

The invention also reduces the quantity of water required for the vacuum pump sealing water system, and this is important in arid areas of the country where water is costly.

Other objects and advantages will appear during the course of the following description.

BRIEF DESCRIPTION OF THE DRAWINGS

The drawings illustrate the best mode presently contemplated of carrying out the invention.

DESCRIPTION OF THE ILLUSTRATED EMBODIMENT

Figure 1:
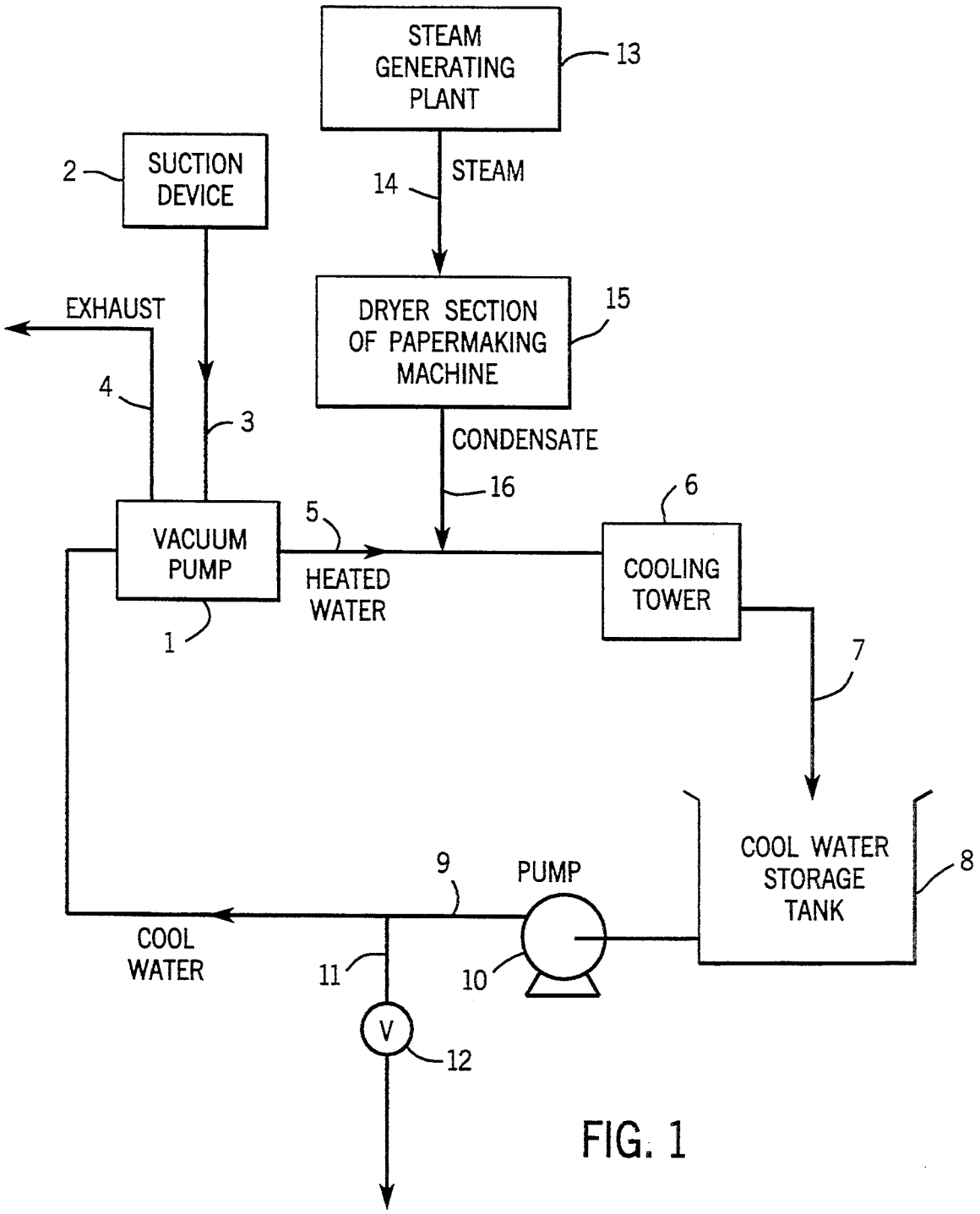
FIG. 1 is a flow diagram showing the process of the invention.

A plurality of water seal vacuum pumps can be utilized in a papermaking machine to generate a subatmospheric pressure or vacuum in suction devices, such as suction boxes, couch rolls and the like, in order to extract water from the wet paper web which is passing over the device. A typical papermaking machine may contain from about five to seven water seal vacuum pumps, with each pump generating a vacuum in the range of about 3 to 24 inches of mercury. Depending upon the location of use, certain of the vacuum pumps may create a high vacuum in the upper portion of the above range, while other vacuum pumps may create a low vacuum in the lower portion of the above range.

The drawing is a flow diagram illustrating the sealing water flow system of the invention for a water seal vacuum pump as used in the papermaking machine. The water seal vacuum pump 1 operates to draw a vacuum in suction device 2, which can take the form of a suction box, couch roll, or the like, through line 3, and air and water vapor are exhausted from the pump through line 4.

During operation of pump 1, the sealing water will be heated by the mechanical operation of the pump, as well as by condensation of water vapor which is drawn into the pump through line 3. In order to maintain the sealing water at a given temperature range and prevent vaporization of the sealing water, the sealing water is continuously discharged from pump 1 through line 5 to a cooling tower 6. Cooling tower 6 is a conventional type in which the heated sealing water is cascaded downwardly through the tower during the cooling operation. A portion of the water is evaporated in tower 6, thus requiring makeup water to be added to the sealing water system.

The cooled water, which is at a temperature generally in the range of 40° F. to 110° F. is discharged from the cooling tower 6 through line 7 to a water storage tank 8, which typically is an open, non-pressurized tank. Water from tank 8 is then recirculated through line 9 to the vacuum pump by circulating pump 10. In addition, a bypass or discharge line 11 is connected to line 9 and flow through line 11 is controlled by a suitable valve 12.

As shown in the drawing, steam from a steam generating power plant 13 is conducted through line 14 to the dryer drums in the dryer section 15 of the papermaking machine, and the steam serves to dry the paper web which travels over the outer surface of the drums. Steam condensate is discharged from the dryer drums of dryer section 15 through line 16, and is fed into the line 5 upstream of the cooling tower. Thus, the steam condensate, which is at an elevated temperature slightly below the vaporization temperature of water, is combined with the heated water from the vacuum pumps and supplied to the cooling tower 6.

As the condensate supplied through line 16 is substantially free of dissolved inorganic salts, there is no buildup of salt in the closed water system. A portion of the water flowing through the system can be discharged through line 11 to maintain the desired water volume in the system. As the water discharged through line 11 is of high quality, containing no significant ionic content, it can be used in critical areas of the papermaking process which require substantially pure water, as for example lubrication showers and needle showers.

As there is virtually no buildup of sulfate or chloride ions in the closed system which can cause corrosion problems, maintenance is substantially reduced over conventional vacuum pump sealing water systems.

Closed water systems normally require the use of a biocide to maintain bacteria at an acceptable controlled level. In a conventional vacuum pump sealing water system in which the "blow down" effluent contains a substantial amount of dissolved inorganic salts and BOD, the effluent must normally be treated by an aerobic or anaerobic process to reduce the oxygen demand before it can be discharged into the sewer system. Therefore, in the conventional system, it is necessary to strike a balance such that there is a sufficient concentration of biocide to maintain a very low level of bacteria in the cooling system and yet the concentration of biocide must not be so high that it would destroy bacteria needed for treatment of the effluent. In the process of the invention, control of the biocide is not nearly as critical because the volume of "blow down" water is very small. Additionally, since the "blow down" water is low in inorganic salts, it is suitable for use in other areas of the papermaking process, and therefore is not discharged to the sewer system.

While the above drawing shows a cooling system for each water seal vacuum pump, it is contemplated that when the papermaking machine includes both high vacuum and low vacuum pumps, the high vacuum pump can use the incoming cool sealing water and the heated sealing water can then be discharged from the high vacuum pump to the low vacuum pump. The low vacuum pumps can use the heated water without heating the water to a vaporization temperature.

Various modes of carrying out the invention are contemplated as being within the scope of the following claims, particularly pointing out and distinctly claiming the subject matter which is regarded as the invention.

We claim:

1. In a method of papermaking, the steps comprising connecting the suction side of a water seal vacuum pump to a suction device in a papermaking machine, operating said vacuum pump to heat the pump sealing water and create a subatmospheric pressure in said suction device to extract water from a paper web moving across said device, discharging the heated sealing water through a first conduit to a heat exchanger to cool the water, returning cool water from the heat exchanger to the vacuum pump through a second conduit, supplying steam to a dryer section of the papermaking machine to dry the paper web, condensing the steam in the dryer section and introducing the steam condensate into said first conduit along with said heated sealing water, and discharging a portion of the sealing water being circulated through said second conduit.

2. The method of claim 1, wherein said step of operating said vacuum pump to create a subatmospheric pressure comprises creating a pressure in the range of 3 to 24 inches of mercury.

3. The method of claim 1, wherein said heat exchanger comprises a cooling tower and said method comprises the steps of cascading the cooling water downwardly through the tower.

4. The method of claim 1, wherein the step of returning cool water to the vacuum pump comprises pumping the cool water to the vacuum pump.

5. The method of claim 1, wherein the step of discharging a portion of the water comprises discharging the water to an operating component of the papermaking machine other than said vacuum pump.

6. A method of supplying water to a water seal vacuum pump, comprising the steps of continuously discharging heated water from a water seal vacuum pump through a first conduit to a cooling tower, flowing the heated water through the cooling tower to cool the water, returning the cooled water through a second conduit to the water seal vacuum pump, supplying steam condensate from a dryer section of a papermaking machine to said first conduit and mixing said condensate with said heated water, and continuously discharging a portion of the water being circulated through said second conduit to a site of use in the papermaking machine.

* * * * *